US007077169B2

(12) United States Patent
Bruynoghe

(10) Patent No.: US 7,077,169 B2
(45) Date of Patent: Jul. 18, 2006

(54) GRIPPER FOR AN AXMINSTER GRIPPER WEAVING MACHINE

(75) Inventor: Koen Bruynoghe, De Pinte (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 59 days.

(21) Appl. No.: 10/442,200

(22) Filed: May 21, 2003

(65) Prior Publication Data

US 2003/0217781 A1 Nov. 27, 2003

(30) Foreign Application Priority Data

May 21, 2002 (BE) ..... 2002/0333

(51) Int. Cl.
*D03D 47/20* (2006.01)

(52) U.S. Cl. ..... 139/447; 139/448; 139/7 D

(58) Field of Classification Search ..... 139/7 D, 139/447, 448; 24/545–563
See application file for complete search history.

(56) References Cited

U.S. PATENT DOCUMENTS 2,728,359 A * 12/1955 Pfarrwaller ..... 139/448
2,845,095 A * 7/1958 Pfarrwaller ..... 139/448
3,072,155 A * 1/1963 Pfarrwaller et al. ..... 139/448
3,288,173 A * 11/1966 Golobart ..... 139/448
3,613,740 A * 10/1971 Geiger ..... 139/445
3,851,676 A * 12/1974 Kokkinis ..... 139/448
3,878,587 A * 4/1975 Marti ..... 24/132 R
3,998,251 A * 12/1976 Hadam ..... 139/448
4,117,871 A * 10/1978 Burer ..... 139/429
4,875,505 A * 10/1989 Moeneclaey et al. ..... 139/448
5,083,585 A * 1/1992 Rheinganz ..... 139/448
6,089,281 A * 7/2000 Anderson ..... 139/448
6,397,439 B1 * 6/2002 Langford ..... 24/518

FOREIGN PATENT DOCUMENTS

| | | |
|---|---|---|
| GB | 158745 | 2/1921 |
| GB | 441938 | 1/1936 |
| GB | 915059 | 1/1963 |

* cited by examiner

*Primary Examiner*—John J. Calvert
*Assistant Examiner*—Robert H Muromoto
(74) *Attorney, Agent, or Firm*—James Creighton Wray

(57) ABSTRACT

A gripper for an Axminster weaving machine comprises at least two clamping parts (2,3) connected to one another and moving with respect to one another for clamping and releasing a pile yarn. The clamping parts (2,3) are interconnected by means of intermediate springy elements (4*a*,4*b*, 4*c*). The clamping parts (2,3) are preferably provided above one another in their plane of movement.

10 Claims, 2 Drawing Sheets

PRIOR ART

GRIPPER FOR AN AXMINSTER GRIPPER WEAVING MACHINE

This application claims the benefit of Belgian Application No. 2002/0333 filed May 21, 2002.

BACKGROUND OF THE INVENTION

The invention relates to a gripper for an Axminster weaving machine, comprising at least two clamping parts connected to one another and moving with respect to one another for clamping and releasing a pile yarn.

For a long time already, the use of grippers is known with the Axminster gripper-weaving machine. A gripper consists of two parts, hingedly connected to one another, the gripper being opened or closed in order to clamp or release a pile yarn by a relative movement of one part with respect to the other part.

A first disadvantage of such known grippers is that the hinged joint is subject to wear and tear and will result in maintenance costs.

SUMMARY OF THE INVENTION

It is a purpose of the present invention to provide a gripper for an Axminster gripper-weaving machine for which the costs of maintenance may be reduced.

According to the invention, this purpose is attained in an efficient manner, by providing a gripper for an Axminster gripper weaving machine, comprising at least two clamping parts joined to one another and moving with respect to one another for clamping and releasing a pile yarn, said clamping parts being interconnected by means of intermediate springy elements.

A second disadvantage of such well known grippers is that, as there is only a restricted width available for each gripper, moreover, in practice, a countersunk area has to be provided on the two parts, for instance, by milling or by means of the die in a stamping process, so that the overall thickness measured, remains restricted and yet the gripper will remain sufficiently rigid. Such treatments may have a negative influence on the straightness of the parts, requiring more time for installing and adjusting when starting up the machine.

An additional purpose consists in providing a gripper for an Axminster gripper weaving machine having one or more characteristics of this invention, but for which the thickness of the gripper will be likewise reduced and more grippers per unity of length may be brought into the weaving machine.

This purpose is attained by providing a gripper for an Axminster gripper weaving machine according to the present invention, said clamping parts being provided above one another in their plane of movement.

In a preferred embodiment of a gripper according to the invention said intermediate springy elements are narrow springy strips, so that carrying out a relative movement of the two clamping parts with respect to one another, the extremities of the clamping parts are able to open and close in order to clamp or to release a pile yarn.

Preferably the narrow springy strips of a gripper according to the invention are made of the same material as the clamping parts.

In a preferred embodiment of a gripper according to the invention, the clamping parts and the narrow springy strips are made of one piece.

Preferably, the clamping parts are provided with a toothing there where the pile yarn is clamped.

In this manner the yarn will not get loose from the clamping parts when the gripper takes along the pile yarn.

In a preferred embodiment of a gripper according to the invention each of the said clamping parts is provided with one or more projections, the projections having been provided on their respective clamping parts in such a manner, that during clamping the pile yarn, the first projection of the first clamping part fits, at least partly, into a second clamping part with its second projection.

This has the advantage that when the gripper closes, the movement near the toothing of the two clamping parts is guided and thus the clamping parts moving next to one another near the toothing and the pile yarn not being clamped sufficiently is avoided.

In a preferred embodiment of a gripper according to the invention, two projections have been provided on each of the said clamping parts, each of the projections having a thickness corresponding to nearly half of the thickness of their respective clamping parts.

In a more preferred embodiment of a gripper according to the invention the projections per clamping part take up a different half of their respective clamping parts.

Preferably, the said projections are located near the said toothing.

The invention will now be further explained on the basis of the following detailed description of a preferred gripper for an Axminster gripper-weaving machine according to the present invention. The intention of this description is to give only a clarifying example and to indicate further advantages and particulars of the present invention and therefore may in no way be interpreted as a restriction of the field of application of the invention or of the protection of the patent rights demanded in the claims.

BRIEF DESCRIPTION OF THE DRAWINGS

In this detailed description reference is made, by means of reference numbers, to the enclosed drawings, in which.

DETAILED DESCRIPTION OF THE PREFERRED EMBODIMENTS

Figure 1:
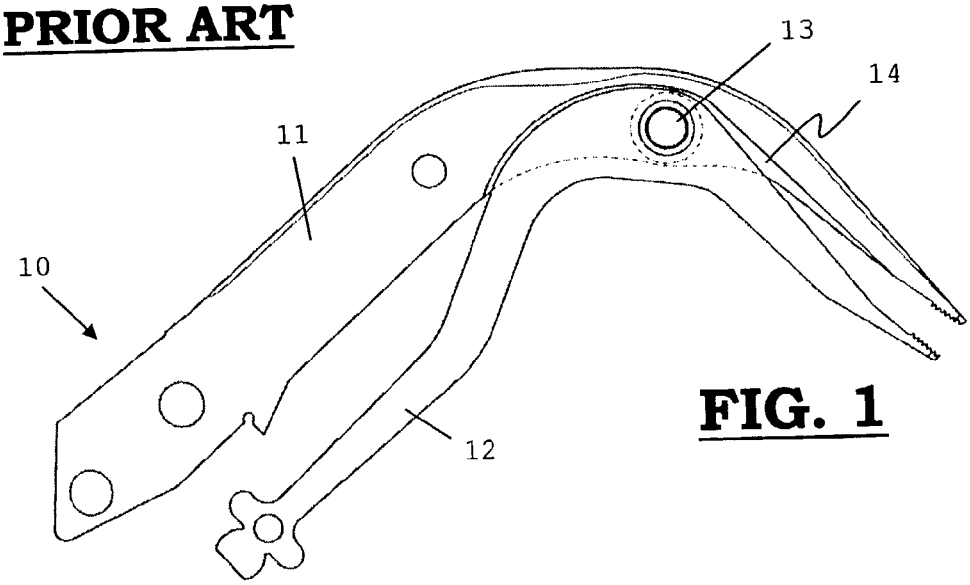
FIG. 1 is a front view of a gripper for an Axminster weaving machine according to the state-of-the-art.

A gripper (10) for an Axminster gripper-weaving machine according to the state-of-the-art as shown in FIG. 1, consists of two hinged clamping parts (11,12) connected to one another by means of a hinging point (13). Because only a limited width is available for each gripper in the Axminster gripper weaving machine, the first hinged clamping part (1) is provided with a countersunk area (14) which is provided, for instance, by milling or by means of a die in a stamping process, so that the overall thickness measured remains restricted and yet the gripper (10) will remain sufficiently rigid, what may have a negative influence on the straightness of the parts, because of which more time will be required for installing and adjusting when starting up the Axminster gripper weaving machine.

Figure 2:
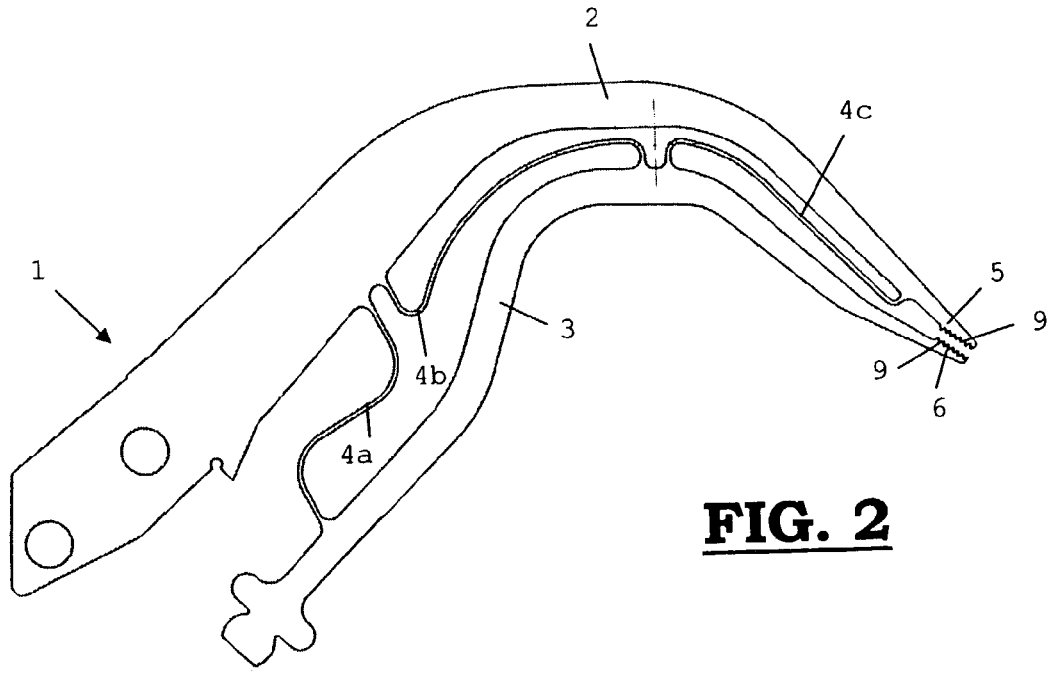
FIG. 2 is a front view of a first embodiment of a gripper for an Axminster gripper-weaving machine according to the invention.
Figure 3:
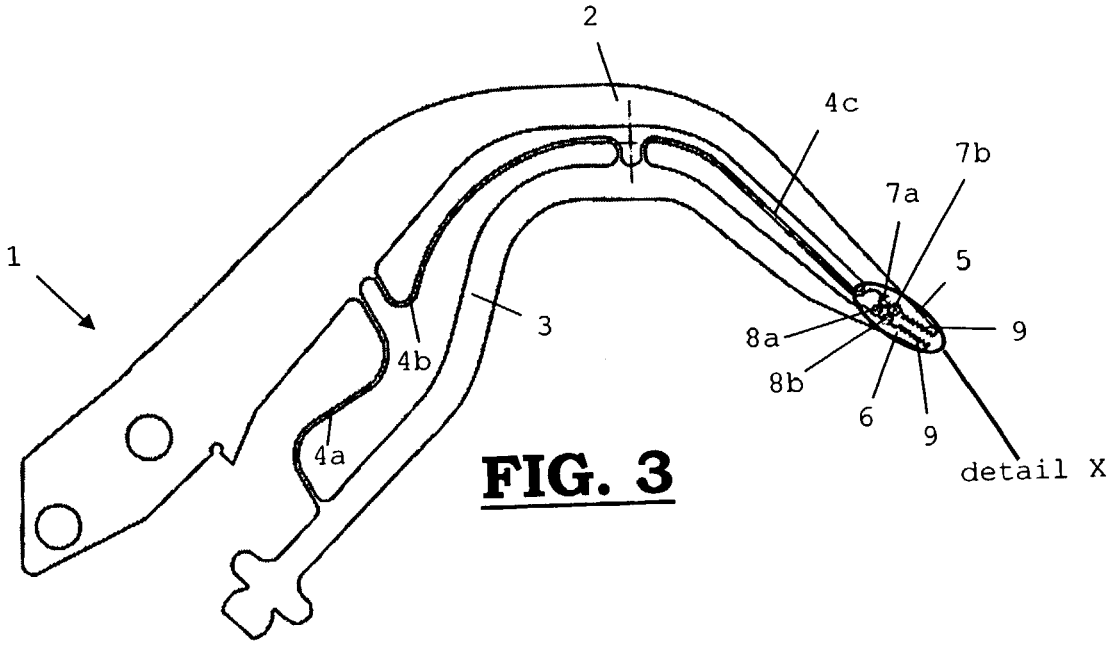
FIG. 3 is a front view of a second embodiment of a gripper for an Axminster gripper-weaving machine according to the invention.

In a first and a second embodiment of a gripper (1) for an Axminster gripper weaving machine according to the invention, as represented in FIGS. 2 and 3, the gripper consist of two clamping parts (2,3) connected to one another by narrow intermediate springy elements, more particularly narrow springy strips (4*a*,4*b*,4*c*) in such a manner that, because of the elastic properties of the springy strips (4*a*,4*b*,4*c*) the two clamping parts (2,3) of the gripper are able to move, so that when carrying out a relative movement of the first clamping part (2) with respect to the second clamping part (3) the extremities (5,6) are able to open or close in order to clamp or to release a pile yarn.

Preferably, the springy strips (4*a*,4*b*,4*c*) are made of the same material as the two clamping parts (2,3). Preferably, the gripper (1) is made in one piece.

Figure 4:
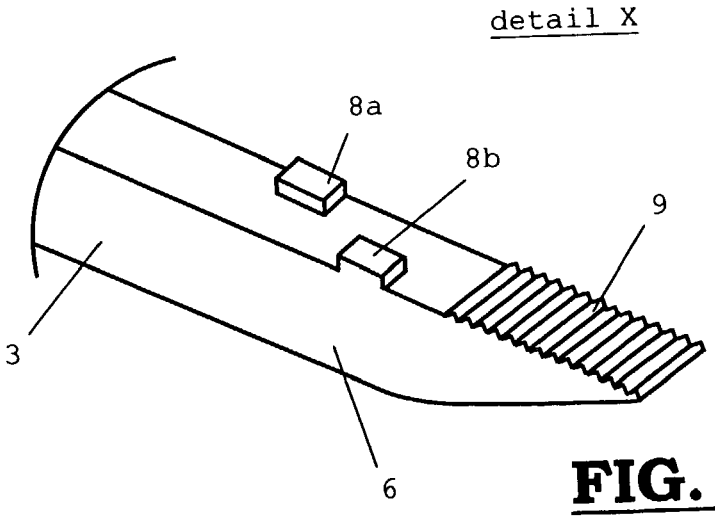
FIG. 4 is a perspective view of detail X as indicated in FIG. 3.

There where the pile yarn is clamped, a toothing (9) has been provided, as is also represented in FIG. 4.

In the second embodiment of a gripper (1) according to the invention, such as represented in FIG. 3 for each clamping part (2,3) two projections (7*a*,7;8*a*,8*b*) are provided near the toothing (as represented in FIG. 4), the projections (7*a*,7;8*a*,8*b*) being provided on their respective clamping parts (2,3) in such a manner that during clamping the pile yarn, the first projection (7*a*,7*b*) of the first clamping part (2) fits, at least partly, into a second clamping (3) part with its second projection (8*a*,8*b*). Preferably these projections (7*a*,7*b*;8*a*,8*b*) have a thickness, which is nearly half the thickness of the respective clamping part (2,3). Preferably, the two projections (7*a*,7;8*a*,8*b*) take up a different half of their respective clamping part (2, 3). So consequently in the position in which the pile yarn is clamped, the two clamping parts (2,3) with their corresponding projections (7*a*,8*a*) and (7*b*,8*b*) fit next to one another, because the first projections (7*a*,7*b*) on the first clamping part (2) partly (preferably entirely) fit into the second projections (8*a*,8*b*) on the second clamping part (3), because the first projections (7*a*,7*b*) take up one half of the thickness of the first clamping part (2) and the second projections (8*a*,8*b*) take up the other half of the thickness of the second clamping part (3). In this manner, the two clamping parts (2,3) are prevented from moving next to one another when the gripper (1) closes near the toothing (9) of the two clamping parts (2,3).

In such embodiments of a gripper (1) for an Axminster gripper weaving machine according to the invention, the hinged joint, which is subject to wear and tear and which is causing maintenance costs, is avoided and it may be produced in a more simple and more exact manner and which at the same time allows the thickness of the grippers to be reduced and therefore more grippers may be installed per unity of length in the Axminster weaving machine.

The invention claimed is:

1. Gripper apparatus comprising a gripper for an insertion of a pile yarn Axminster gripper weaving machine, each gripper further comprising first and second interconnected clamping parts and each clamping part having first and second opposite extremities movable with respect to one another, for clamping and releasing pile yarns, wherein said first and second clamping parts are interconnected and pivot solely by intermediate, springy elements.

2. Gripper apparatus according to claim 1, wherein said clamping parts are provided aligned with one another in their plane of movement.

3. Gripper apparatus according to claim 1, wherein said intermediate springy elements are narrow springy strips, so that, when carrying out a relative movement with respect to one another of the two clamping parts, the first extremities of the clamping parts open and close to clamp or to release a pile yarn when the second extremities move toward and away from each other.

4. Gripper apparatus according to claim 3, wherein the narrow springy strips are made of the same material as the clamping parts.

5. Gripper apparatus according to claim 3 wherein the clamping parts and the narrow springy strips are made in one piece.

6. Gripper apparatus according to claim 1, wherein the first extremities of the clamping parts are provided with opposed toothing there where the pile yarns are clamped.

7. Gripper apparatus according to claim 6, wherein the said clamping parts are provided with first and second projections, the first and second projections being provided on the respective first and second clamping parts, in such a manner that during clamping the pile yarn, the first projection on the first clamping part interfits with the second projection on the second clamping part.

8. Gripper apparatus according to claim 7, wherein the first and second projections further comprise two projections on each of the said clamping parts each of the projections having a thickness corresponding to nearly half of the thickness of its respective clamping part.

9. Gripper apparatus according to claim 8, wherein the two projections per clamping part take up a different halves of their respective clamping part.

10. Gripper apparatus according to claim 7, wherein the said projections are located near the said toothing.

* * * * *